US006491182B1

(12) United States Patent
Holroyd et al.

(10) Patent No.: US 6,491,182 B1
(45) Date of Patent: Dec. 10, 2002

(54) TREATING PRESSURE VESSELS

(75) Inventors: Nigel John Henry Holroyd, Riverside, CA (US); Warren Hepples, Bloxham (GB); Yi Gao, Banbury (GB)

(73) Assignee: Luxfer Group Limited, Manchester (GB)

( * ) Notice: Subject to any disclaimer, the term of this patent is extended or adjusted under 35 U.S.C. 154(b) by 0 days.

(21) Appl. No.: 08/817,435

(22) PCT Filed: Oct. 12, 1995

(86) PCT No.: PCT/GB95/02420

§ 371 (c)(1),
(2), (4) Date: Jul. 29, 1997

(87) PCT Pub. No.: WO96/11759

PCT Pub. Date: Apr. 25, 1996

(30) Foreign Application Priority Data

Oct. 13, 1994 (EP) ..... 94307509

(51) Int. Cl.[7] ..... B21D 26/02; F17C 1/14
(52) U.S. Cl. ..... 220/581; 220/608; 72/56
(58) Field of Search ..... 220/581, 585, 220/586, 561, 560.04, 608; 72/56; 29/446, 447

(56) References Cited

U.S. PATENT DOCUMENTS

| | | | | | |
|---|---|---|---|---|---|
| 3,438,113 | A | | 4/1969 | Berman et al. | |
| 4,417,459 | A | * | 11/1983 | Tomita | 72/56 |
| 4,571,969 | A | * | 2/1986 | Tomita | 72/56 |
| 4,589,562 | A | * | 5/1986 | Fawley | 220/590 |

FOREIGN PATENT DOCUMENTS

| | | |
|---|---|---|
| DE | A3603415 | 10/1986 |
| DE | A250234 | 10/1987 |
| EP | A0070790 | 1/1983 |

* cited by examiner

*Primary Examiner*—Lee Young
*Assistant Examiner*—Niki M. Eloshway
(74) *Attorney, Agent, or Firm*—Nixon & Vanderhye P.C.

(57) ABSTRACT

A pressure vessel has a cylindrical side wall and a closed end joined to the side wall at a knuckle. The fatigue resistance of the pressure vessel is improved by autofrettage which moves a region of peak stress from the internal surface of the vessel to a region within the knuckle. Preferred are pressurized gas vessels of 6000 or 7000 series aluminum alloys.

13 Claims, 7 Drawing Sheets

ANGLED BASE

FLAT BASE

TREATING PRESSURE VESSELS

BACKGROUND OF THE INVENTION

1. Field of the Invention

This invention concerns pressure vessels, for example, high pressure gas cylinders.

2. Discussion of Prior Art

Such pressure vessels are currently manufactured in aluminium, steel and composite materials. These vessels need to have excellent fracture and fatigue properties. Repeated cycling of pressure inside the vessel causes the vessel to flex, and flexing encourages propagation of any cracks that may appear at the metal surface. Fatigue crack initiation and growth in such vessels occurs at those points where pressure cycling causes maximum flexing (change in strain). This invention concerns treatment of pressure vessels to improve their resistance to fatigue and prevention of premature burst failure.

An established method for improving the fatigue resistance of tubes and cylinders is known as autofrettage. This involves applying a pressure within the bore of the cylinder or tube sufficient to plastically deform the metal at the inner surface. The technique produces compressive residual stresses near the bore, and thus enhances the fatigue resistance of the tube or cylinder subjected to cyclic internal pressure loading. The technique has been applied to continuous lengths of thick walled tubing for at least 70 years.

Autofrettage has also been applied to pressure vessels known as full wrap cylinders, whereby generally a complete thin-walled metal e.g. aluminium inner liner is put into compression. This invention is not concerned with full wrap cylinders of that kind.

U.S. Pat. No. 3,438,113 describes the application of autofrettage to metallic pressure vessels, with the object of increasing the permissible internal pressure loading of the vessel. The invention involves performing autofrettage with the vessel at elevated temperature.

SUMMARY OF THE INVENTION

Fatigue failure of pressure vessels such as high pressure gas cylinders particularly those with flat bottoms normally occurs, not in the cylindrical wall, but at or adjacent the closed end of the vessel. This invention arises from the idea that the autofrettage technique might be used to improve the fatigue performance of such closed-end vessels.

In one aspect the invention provides a method of treating a pressure vessel of aluminium or an Al alloy, having a cylindrical side wall and a closed end and having, when at service pressure, at least one region of peak stress located at an internal or external surface of or adjacent the said closed end, which method comprises subjecting the inside of the vessel to autofrettage by applying a pressure sufficient to plastically deform the said at least one region, said plastic deformation being confined to less than 25% of the wall thickness, whereby the treated pressure vessel has the property that, when at elevated pressure, each region of peak stress is located away from any internal or external surface at a distance less than 25% of the wall thickness from said internal or external surface.

A region of peak stress is defined as one where the local stress decreases in all directions with increasing distance from the region.

An effect of this treatment is to reduce the absolute value of the peak stress (when the cylinder is under any pressure above atmospheric and less than the autofrettage pressure) in the region of stress raisers (discussed below), and to move the position of peak stress away from a surface of the vessel. Thus in another aspect the invention provides a pressure vessel of aluminium or an Al alloy having an axis, a cylindrical side wall and a closed end joined to the side wall at a knuckle, and having the property that, when at elevated pressure, a region of peak stress is located, within the material of the vessel away from any internal or external surface at a distance less than 25% of the wall thickness from said internal or external surface, in the knuckle and/or axially of the vessel in the closed end. Preferably the said region of peak stress is located within the material of the vessel at least 0.5 mm away from any internal or external surface.

Surface flaws are tears, pits, creases and are typically up to 1–200 $\mu$m deep. If regions of peak stress coincide with these surface flaws, they tend to propagate. Moving regions of peak stress at leas 0.55 mm into the interior of the material of the vessel should reduce or avoid this problem.

Autofrettage is normally performed at ambient temperature. At temperatures substantially above ambient, the creep properties of aluminium become more pronounced, and this progressively reduces the beneficial effects of autofrettage.

The vessel may be of any aluminium (including alloys where aluminium is the major component) material that can be formed into an appropriate shape and provide sufficient properties such as mechanical strength, toughness and fatigue and corrosion resistance. Among aluminium alloys, those of the 2000, 5000, 6000 and 7000 Series have been used to make pressure vessels and are preferred for this invention. The vessel is preferably formed by extrusion.

Although hot extrusion according to the invention is possible, cold or warm extrusion is preferred as being a lower cost procedure. Cold or warm extrusion may also give rise to an extrudate having a better combination of strength and toughness properties. The preferred technique is backward extrusion. This technique involves the use of a recess, generally cylindrical, with parallel side walls, and a ram to enter the recess, dimensioned to leave a gap between itself and the side walls equal to the desired thickness of theextrudate. An extrusion billet is positioned in the recess. The ram is driven into the billet and effects extrusion of the desired hollow body in a backwards direction. The forward motion of the ram stops at a distance from the bottom of the recess equal to the desired thickness of the base of the extruded hollow body. Extrusion speed, the speed with which the extrudate exits from the recess, is not critical but is typically in the range 50–500 cm/min. Lubrication can substantially reduce the extrusion pressure required.

The initial extrudate is cup-shaped, with a base, parallel side walls and an open top. The top is squared off and heated, typically induction heated to 350–450° C., prior to the formation of a neck by swaging or spinning. The resulting hollow bodyis solution heat treated, quenched, generally into col water, and finally aged.

The requirements of backward extrusion place constraints on the shape of the closed end of the resulting vessel, particularly the base and a knuckle by which the base is joined to the cylindrical side wall. Other production techniques may place other constraints on the geometry of the vessel.

The inventors have performed finite element analysis which shows tht the major stress raisers in such hollow bodies are located in two places: on the inside of the vessel at the knuckle where the base joins the side wall; and on the outside of the vessel at the centre of the base. The relative values of these stress raisers may depend on the cylinder wall and base thicknesses, the dimensions particularly the diameter of the vessel, and the particular base geometry chosen, especially the internal base radius of the knuckle. The method of the invention involves applying a pressure within the vessel sufficient to cause plastic deformation of the metal at one or both of these regions. The applied pressure must obviously not be so great as to burst the vessel, and is preferably less than that required to cause plastic deformation of metal throughout the thickness of the base or knuckle. The applied pressure may be such as not significantly to plastically deform the side wall of the vessel. Alternatively, any plastic deformation of metal in the side wall should be confined to a region at or adjacent the inner surface thereof, e.g. less than 25% and preferably less than 10% of the wall thickness.

The effectiveness of autofrettage in improving fatigue performance does depend on the design of the closed end of the pressure vessel. Thus for example pressure vessels with hemispherical closed ends do not have regions of peak stress and do not show the advantages of autofrettage described herein. More usually, the closed ends of pressure vessels will have semi-ellipsoidal or torispherical dish shapes, and the fatigue resistance of these can generally be improved by autofrettage as described herein. For further description of these shaped ends, reference is directed to an ASME boiler and Pressure Vessel Publication Code 1, Section VIII, Divisions 1 and 2. The effect of end shape is further described in Example 7 below. As there explained, positive advantages do result from designing a pressure vessel with a closed end joined to a cylindrical side wall by a knuckle whose fatigue properties can be improved by autofrettage.

Aluminium high pressure gas cylinders are usually designed so that the stress in the cylindrical side wall at service pressure does not exceed half the alloy yield stress, and that the cylinder burst pressure is at least 2.25 times the operating pressure. In a 7000 Series alloy cylinder having for example a yield stress of 450 MPa, the design should be such that wall stresses do not exceed 225 MPa. Bearing in mind the required burst pressure, it is possible to calculate the degree of over-pressurisation needed for the internal surface of the cylindrical side wall to start to yield. (Wall stresses at the service pressure are higher at the internal surface unless an autofrettage effect is involved). Calculations for a 175 mm diameter 7000 series alloy cylinder having yield atrength of 450 MPa and a wall thickness of 7.9 mm show that pressurisation to at least 85% and often more than 95% of the burst pressure is needed before the stresses in the cylinder side walls exceed the yield stress. Thus treatment of these cylinders by autofrettage is possible under conditions which do not cause plastic deformation in the side wall. Indeed such treatment is advantageous, for autofrettage at pressures close to the actual burst pressure may lead to problems in manufacture owing to variability in material properties, which for example may lead to unwanted permanent expansion ofthe cylinder (BS 5045: Part 3: 1984, Section 20.4, Volumetric Expansion Test) and therefore would not be recommended as a commercial practice.

The autofrettage pressure is likely to be from 75 to 95%, e.g. 75 to 90%, of the burst pressure of the vessel. A finite element analysis of the effects of the over-pressurisation can be performed to show that the right sort of residual stresses are obtained.

Finite element analysis (FEA) is a useful and powerful technique for determining stresses and strains in structures or components too complex to analyse by strictly analytical methods. With this technique, the structure or component is broken down into many small pieces (finite number of elements) of various types, sizes and shapes. The elements are assumed to have a simplified pattern of deformation (linear or quadratic etc.) and are connected at "nodes" normally located at corners or edges of the elements. The elements are then assembled mathematically using basic rules of structural mechanics, i.e. equilibrium of forces and continuity of displacements, resulting in a large system of simultaneous equations. By solving this large simultaneous equation system with the help of a computer, the deformed shape of the structure or component under load may be obtained. Based on that, stresses and strains may be calculated (See "The Finite Element Method", 3rd Edition, the third expanded and revised section of "The finite element method in Engineering Science", O. C. Zienkiewicz, McGraw Hill Book Company (UK) Ltd, 1977).

The results of such finite element analysis are shown in FIGS. 1 and 2 of the accompanying drawings, each of which is a von Mises Stress Plot of the lower part of the cylindrical side wall, the knuckle and half the base of an aluminium high pressure gas cylinder repressurised to 24.1 MPa. These were generated using a commercially available ANSYS computer programme, versions 5.0 or 5.1.

These FIGS. 1 and 2 show part of a 175 mm diameter cylinder having a particular base profile, a burst pressure of 49.7 to 51.8 MPa and an assumed working pressure of 24.13 MPa (i.e. 1.17 times the normal design service pressure). The von Mises plot of the residual stress is a useful guide to the stress distribution. In each figure, contour lines within the wall and base of the pressure vessel are lines of equal stress value, the values of which are indicated by the letters A to I.

Referring to FIG. 1, the highest von Mises stress components are shown at the inner surface of the internal knuckle radius (371 MPa) and at the external surface in the centre of the base (377 MPa).

FIG. 2 shows the position again at the assumed working pressure of 24.13 MPa but after autofrettage at 44.82 MPa (i.e. 90% of the theoretical burst pressure). The peak von Mises stress at the knuckle has been reduced to 145 MPa and is positioned a few mm away from the internal surface. The peak stress at the centre of the base has been reduced to a value below 282 MPa and is now positioned several mm from the external surface. In both cases, the depth of the peak stress component is now much greater than the depth of any likely surface flaw. These two effects, the reduction in peak stress and its location change should lead to significant increases in the number of loading cycles needed to initiate fatigue crack from a surface flaw.

These computer predictions are borne out in practice, as demonstrated in the examples below.

Any point in a gas cylinder is in a complex stress state, that is, each point is stressed in more than one direction, such as stresses in the hoop direction, in the radial direction and in the longitudinal direction.

Description of Stress at a Point and Principal Stresses:

In solid mechanics, it is convenient to describe stress at a point within a component or a structure on an infinitesimal cube which centres on the point and whose faces are normal to the axes of a chosen coordinate system. The stress is resolved into three normal stresses and six shear stresses acting on the faces of the cube. Since the choice of the coordinate system and its orientation is somewhat arbitrary or for the convenience of analysis, the levels of the normal and shear stresses may vary with the orientation of the coordinate system. There exists a special orientation of the coordinating system. On the faces of the infinitesimal cube aligned to this particular coordinate system, there are only resolved normal stresses and no resolved shear stresses. These special resolved normal stresses are called principal stresses ($\sigma_1$, $\sigma_2$, $\sigma_3$). The maximum principal stress ($\sigma_1$) is the greatest of the three and the minimum principal stress ($\sigma_3$) the least.

von Mises Stress: The mechanical properties (modulus of elasticity, yield stress, work hardening and plastic deformation beyond yielding, etc.) of a ductile material such as an aluminium alloy are normally established through tensile tests. Tensile tests are carried out under uniaxial stress conditions. Stress-strain curves are obtained. In order to conduct stress analysis on a multi-axially stressed component or structure, it is necessary to establish a correlation between the multi-axial stress-strain relationship and the uniaxial stress-strain relationship, especially in the situation of material yielding where Hooke's law is no longer applicable. von Mises proposed a yield criterion which as been generally accepted as the most suitable for the ductile materials.

Beyond yield, the von Mises stress and equivalent strain (defined in a similar form to von Mises stress) will follow the tensile stress-strain curve. Therefore, von Mises stress may be generally used to assess the severity of the stress state at any point of a component or structure, except when the component or structure is predominantly under hydrostatic tension. A gas cylinder is not under such stress condition.

BRIEF DESCRIPTION OF THE DRAWINGS

Reference is directed to the accompanying drawings in which.

DETAILED DISCUSSION OF PREFERRED EMBODIMENTS

The following Examples illustrate the invention. In all cases, autofrettage: was performed at ambient temperature; did move a region of peak stress at the closed end of the vessel to at least 0.5 mm away from an internal or external surface; and did not cause plastic deformation of the cylindrical side wall of the vessel.

EXAMPLE 1

A 7000 series alloy was used for this work, having the composition Zn 5.96%; Mg 2.01%; Cu 1.87%; Cr 0.20%; Fe 0.06%; Si 0.03%; Balance Al. Billets were homogenised at 475 to 485° C., air cooled to ambient temperature, and cold extruded in a backward direction. Necking was performed to form a high pressure gas cylinder, which was solution heat treated for 1 hour at 475° C. followed by 4.25 hours at 180° C., resulting in a 0.2% proof stress value of about 450 MPa.

The number of loading cycles to failure at proof test pressure (34.5 MPa) increased when a 85% autofrettage over-pressurisation was employed, with this increase consistently occurring when other options were used to increase cycle life, e.g. increasing the internal knuckle radius and/or introducing an angled rather than a square external base. The results are set out in Table 1 below. Besides increasing cycle life, the over-pressurisation was found to change the fracture mode, from base separation without over-pressurisation, to a leak from a radial crack with the cylinder remaining in one piece after over-pressurisation.

TABLE 1

| Knuckle Radius % | Over-pressurisation (% of burst pressure) | No. Fatigue Cycles to failure | | Fracture Mode |
|---|---|---|---|---|
| | | Flat Base | Angled Base | |
| 13 | 0 | 4,396 | 4,600 | Base Separation |
| 13 | 85 | 4,725 | 5,249 | Leak |
| 15 | 85 | 5,439 | 6,503 | Leak |

Figure 8B:
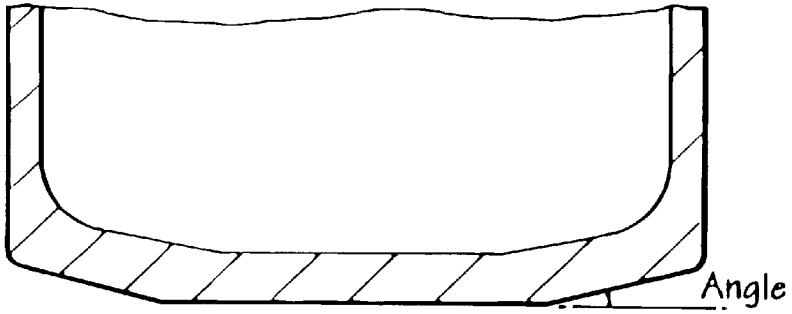
FIGS. 8*a* and 8*b* show flat base and angled base designs referred to in Example 1.
Figure 8A:
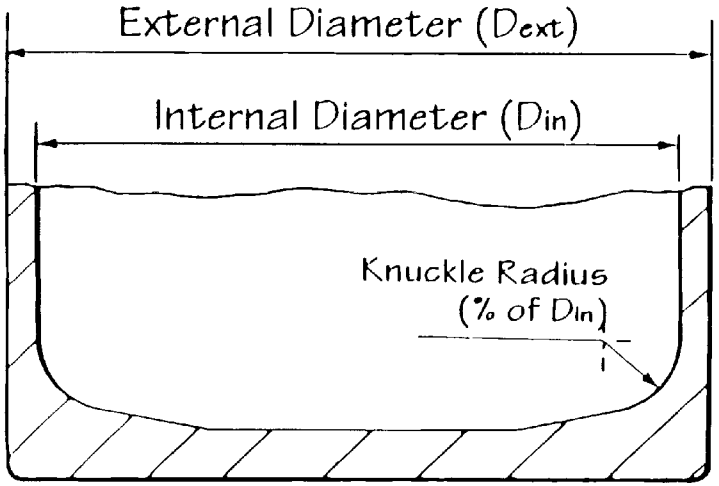

The flat base and angled base designs are shown in section in FIGS. 8*a* and 8*b* respectively.

Figure 1:
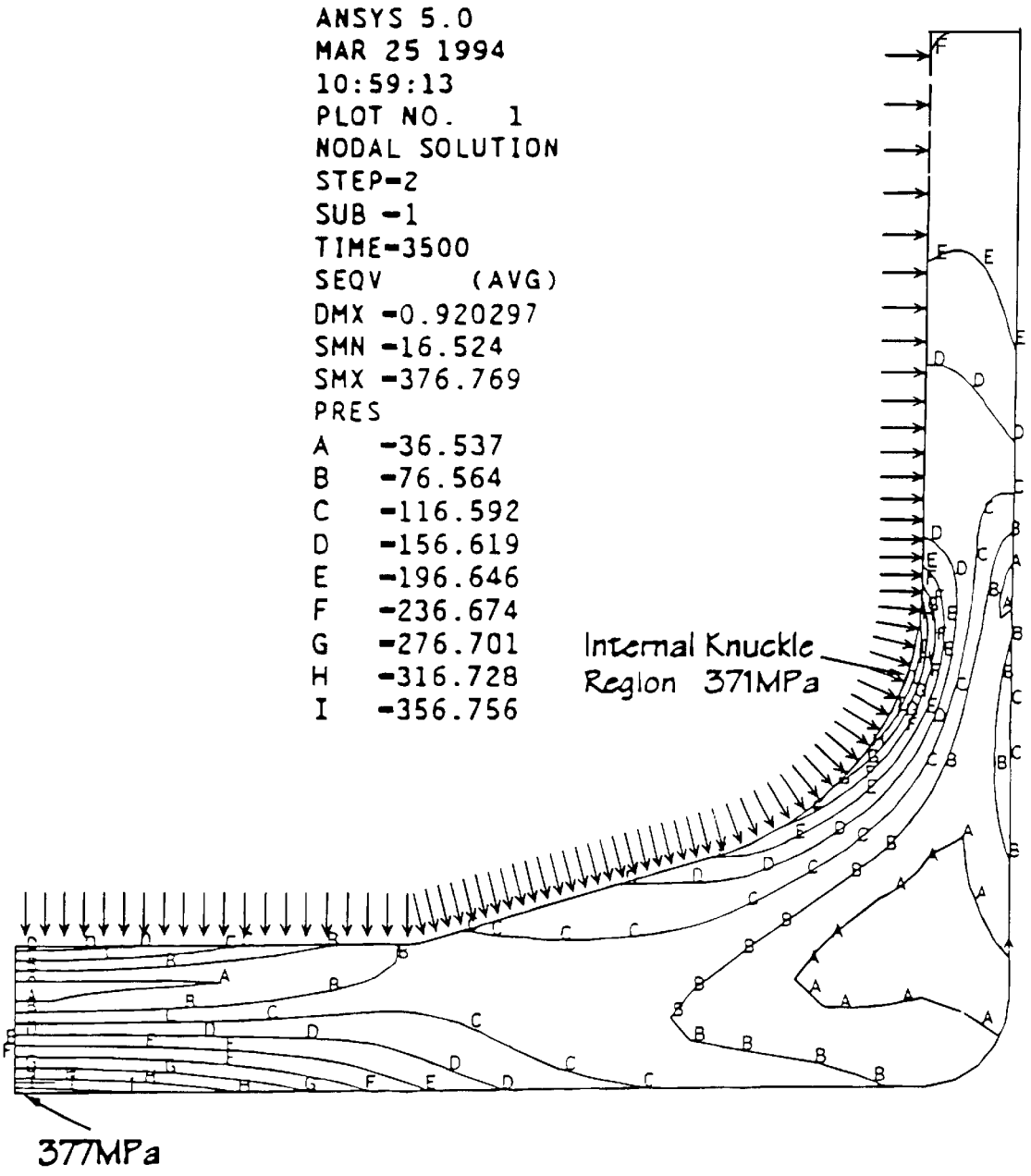
FIGS. 1 and 2 are von Mises stress plots of parts of aluminium gas cylinders, as discussed above.
Figure 2:
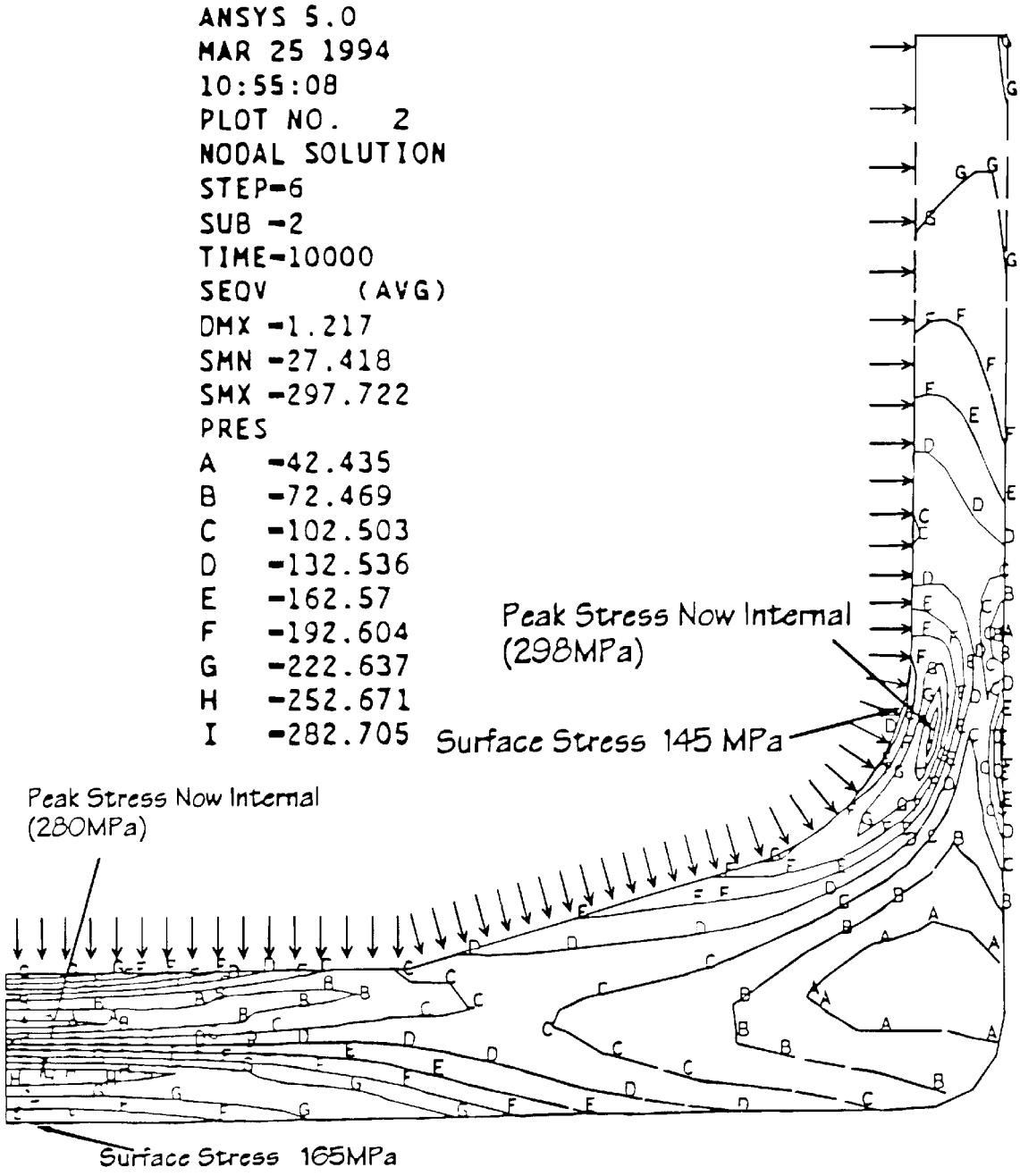
Figure 3:
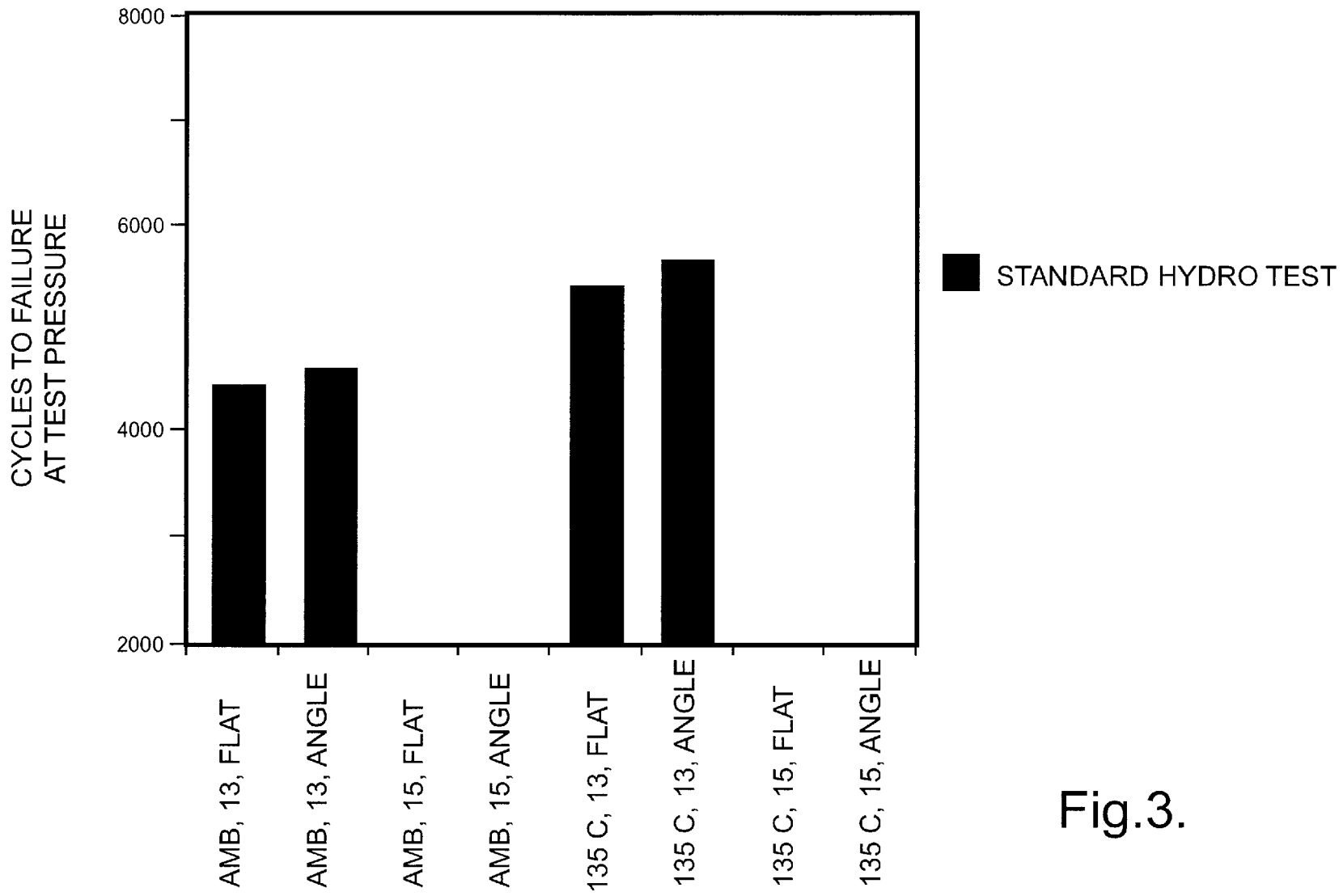
FIGS. 3, 4 and 5 are bar charts of cycles to failure at test pressure showing the effect of cylinder design and autofrettage on fatigue life.
Figure 4:
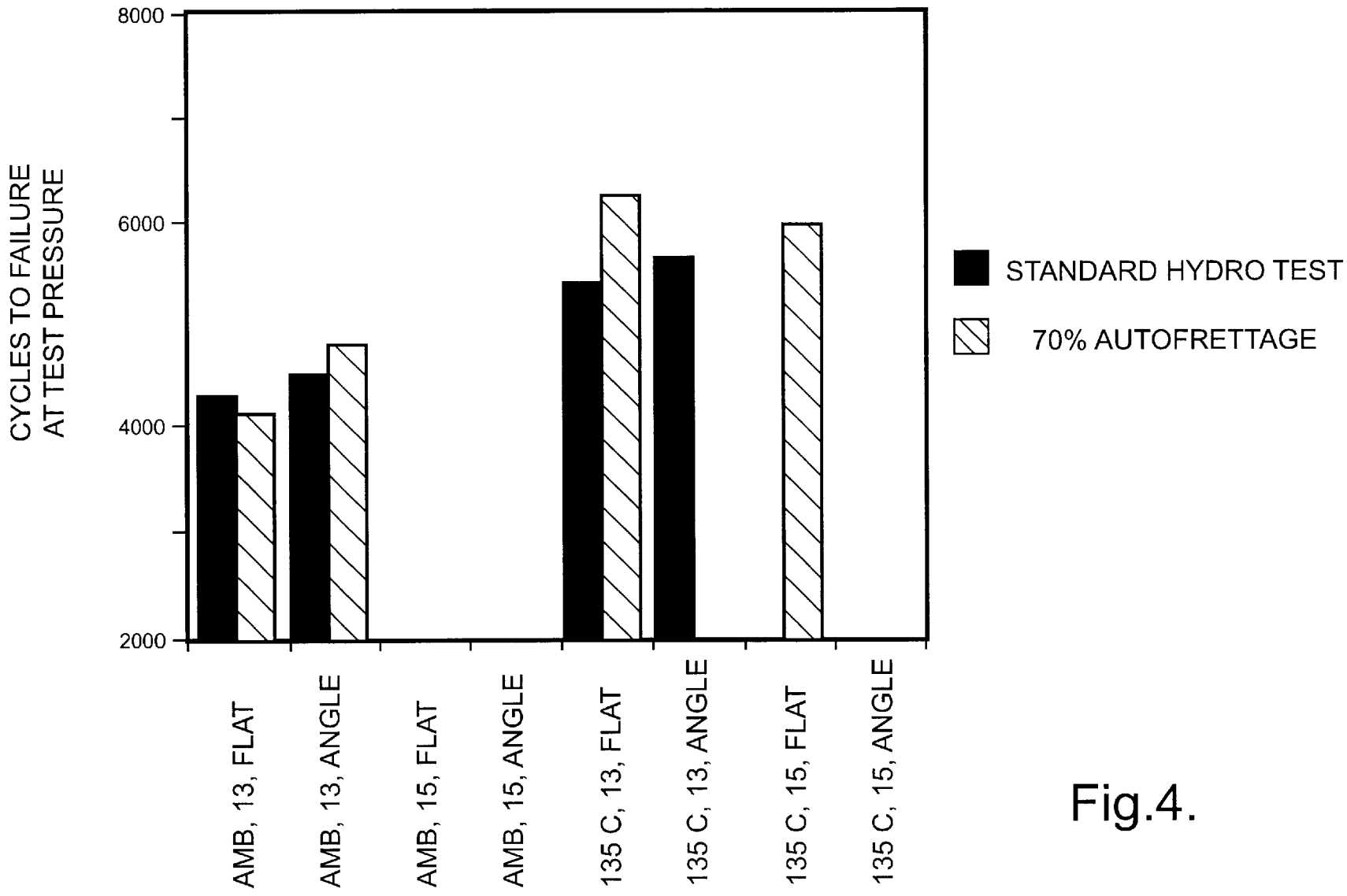
Figure 5:
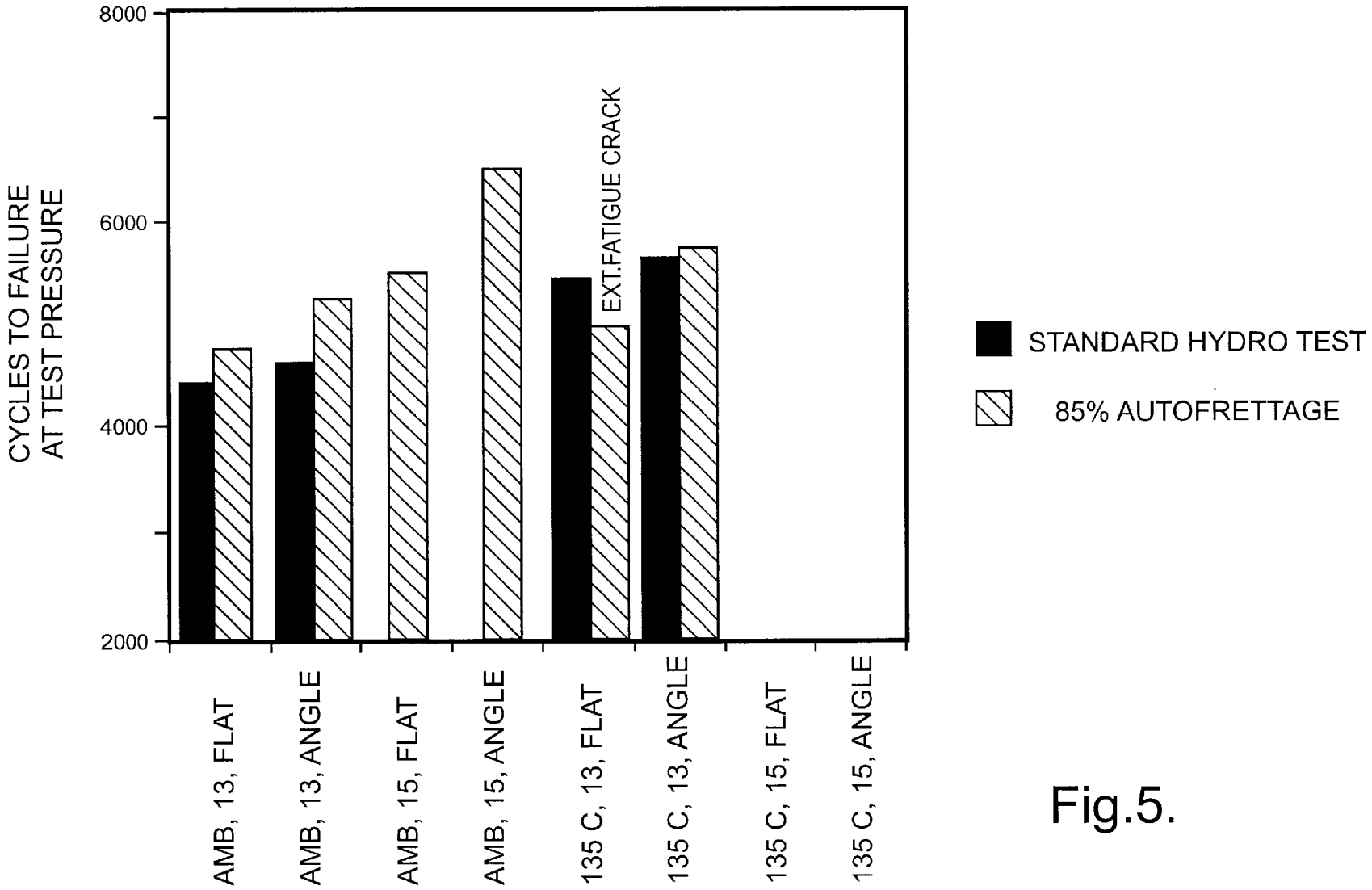

Further results of this work are shown in the accompanying FIGS. 3, 4 and 5, each of which is a bar chart, with the length of the bar showing the number of cycles to failure at test pressure.

The x axis information is listed below:

AMB—billet extruded at room temperature
135° C.—billet heat to 135° C. prior to extrusion
13—internal knuckle radius 13°
15—internal knuckle radius 15°
Angle—external base shape i.e. corner section
Flat—external base shape i.e. standard The results of tests to date are:

FIG. 3: Effect of cylinder design and extrusion temperature on fatigue performance at test pressure.
FIG. 4: As FIG. 3+effect of autofrettage at 70% of burst pressure.
FIG. 5: As FIG. 3+effect of autofrettage at 85% of burst pressure.

EXAMPLE 2

Autofrettage trials were performed on aluminium 6061 alloy cylinders with the same dimensions as in Example 1. Test conditions were as follows:

Service Pressure—12.4MPa

Test Pressure—20.7MPa

Autofrettage Pressure—27.6 MPa

Minimum burst pressure—31.0 MPa

Actual burst pressure—35.2–35.9 MPa

Fatigue test results are set out in the following Tables 2 and 3.

TABLE 2

| Tested at "Test Pressure" | | | |
|---|---|---|---|
| Normal Cylinders | | Autofrettaged Cylinders | |
| Serial No. | Cycles to Failure (Leak) | Serial No. | Cycles to Failure (Leak) |
| 7 | 13,192 | 1 | 28,707 |
| 8 | 12,904 | 2 | 24,281 |
| 9 | 13,506 | 3 | 29,382 |
| Average | 13,201 (1.00) | Average | 27,457 (2.08) |

TABLE 3

| Tested at "Service Pressure" | | | |
|---|---|---|---|
| Normal Cylinders | | Autofrettaged Cylinders | |
| Serial No. | Cycles to Failure (Leak) | Serial No. | Cycles to Failure (Leak) |
| 10 | 129,464 | 4 | >300,000* |
| 11 | 132,180 | 5 | >500,000* |
| 12 | 115,150 | 6 | >500,000* |

*Test terminated prior to failure.

EXAMPLE 3

Autofrettage trials were performed on 7XXX Series alloy cylinders fabricated using the route described in Example 1. In this example, the alloy composition used was Zn 5.91%; Mg 1.95%; Cu 2.03%; Cr 0.20%; Fe 0.11%; Si 0.07%; Balance Al. The cylinder dimensions were: External diameter 203 mm, wall thickness 10.7 mm, base thickness 16 mm and length 1016 mm.

Four levels of autofrettage were used, namely 0, 75, 85 and 95% of the actual burst pressure (57.8±0.1 MPa). Fatigue test results obtained using test pressures of 31 and 37.2 MPa are set out in the following Table 4.

TABLE 4

| Maximum Test Pressure | Cycles to Failure Autofrettage (% actual burst pressure) | | | |
|---|---|---|---|---|
| (MPa) | 0 | 75 | 85 | 95 |
| 31.0 | 9,725 | 10,745 | 12,567 | 13,448 |
| 37.2 | 6,707 | | | 9,940 |

EXAMPLE 4

Autofrettage trials were performed on 7XXX series alloy cylinders fabricated using the route described in Example 1. The alloy composition was:

Zn 6.02, Mg 2.00, Cu 1.97, Cr 0.20, Fe 0.11, Si 0.06 (wt %) and balance Al.

The 10 1 cylinder dimensions (FIG. 6) were as follows:

| | |
|---|---|
| External diameter | 176 mm |
| Mean Wall thickness | 8.9 mm |
| Base thickness | 12.5 mm |
| Overall length | 600 mm |

Four levels of autofrettage were used, namely, 0, 80, 85 and 90% of the theoretical burst pressure (i.e. not the actual burst pressure as used for Examples 1–3).

Test conditions and cylinder specifications are listed below:

| | |
|---|---|
| Service pressure | 20 MPa |
| Test pressure | 30 MPa |
| Minimum Theoretical Burst pressure | 48.2 MPa |
| Actual Burst pressure | 51.0 MPa |
| Autofrettage pressure | 0, 38.6, 41.0 and 43.4 MPa |

Fatigue test results obtained at service pressure and at test pressure are outlined in Table 5.

TABLE 5

| Maximum Cylinder Pressure During Fatigue Test (MPa) | Overpressurisation (% of Minimum Burst | Fatigue Life (Cycles to Failure) |
|---|---|---|
| 30 | 0 | 8338 |
| 30 | 80 | 10836 |
| 30 | 85 | >12000 |
| 30 | 90 | >12000 |
| 20 | 0 | 28,144 |
| 20 | 90 | 58,100 |

EXAMPLE 5

Figure 7:
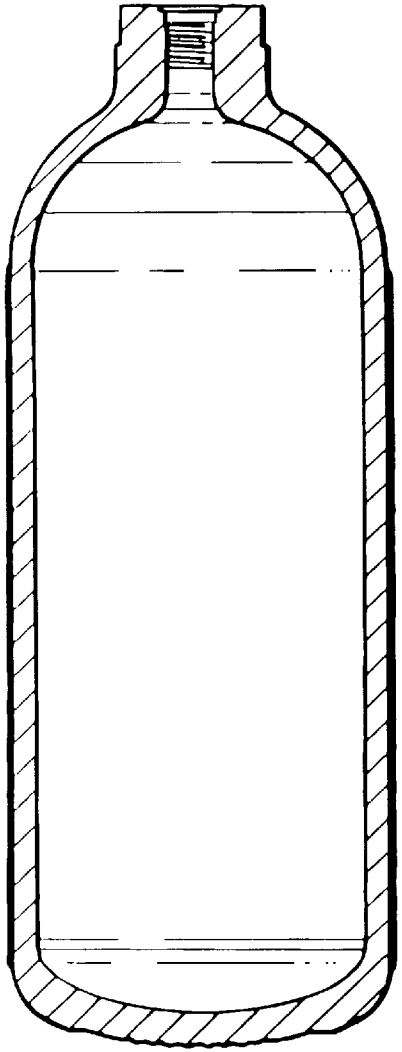
FIGS. 6 and 7 are axial sections through pressure gas containers tested in Examples 4 and 5 below.

Autofrettage trials have been initiated on 6061 hoop wrapped gas cylinders. The cylinder specifications (FIG. 7) were as follows:

| | |
|---|---|
| External diameter | 140 mm |
| Mean wall thickness | 5.9 mm |
| Base thickness | 8.1 mm |
| Overall length | 465 mm |

with a glass fibre composite wrap 1.15 mm thick applied to the barrel section of the aluminium cylinder.

Three levels of autofrettage were used, namely, 118% of test pressure (standard treatment, 71% of minimum theoretical burst pressure), 80% of minimum theoretical burst pressure, 90% of minimum theroetical burst pressure.

Test conditions and cylinder specifications are listed below:

| | |
|---|---|
| Service Pressure | 20 MPa |
| Test Pressure | 30 MPa |
| Minimum Theoretical burst pressure | 50 MPa |

Fatigue test results are set out in Table 6.

TABLE 6

| Maximum Cylinder Pressure During Fatigue Test (MPa) | Overpressurisation (% of minimum theoretical burst pressure) | Fatigue Life (Cycles to Failure) |
|---|---|---|
| 20 | 71 | 67,289 |
| 20 | 80 | 37,257 |
| 20 | 90 | >78,000 |

EXAMPLE 6

Autofrettage trials were performed on 7xxx series alloy cylinders fabricated using the route described in Example 1.

The alloy composition was:

Zn 5.99% Mg 1.99% Cu 2.00% Cr 0.20%

Fe 0.071% Si 0.051% (wt %) and balance Al.

The cylinder dimensions were as follows:

| | |
|---|---|
| External Diameter | 176 mm |
| Mean wall thickness | 8.9 mm |
| Base thickness | 12.5 mm |
| Overall Length | 600 mm |
| Capacity | 10 l |

Autofrettage was carried out at 90% of the actual burst pressure.

Test conditions and cylinder specifications are listed below:

| | |
|---|---|
| Service Pressure | 20 MPa |
| Test Pressure | 30 MPa |
| Minimum Theoretical Burst Pressure | 50.7 MPa |
| Actual Burst Pressure | 56.6 MPa |
| Autofrettage Pressure | 0 and 50.9 MPa |

Fatigue test results obtained at service pressure and at test pressure are outlined in Table 7 below.

TABLE 7

| Maximum Test Pressure (MPa) | Autofrettage (% of Actual Burst Pressure) | Fatigue Life (Cycles to Failure) |
|---|---|---|
| 20 | 0 | 40 036 |
| 20 | 95 | 210 000 |

EXAMPLE 7

Figure 6:
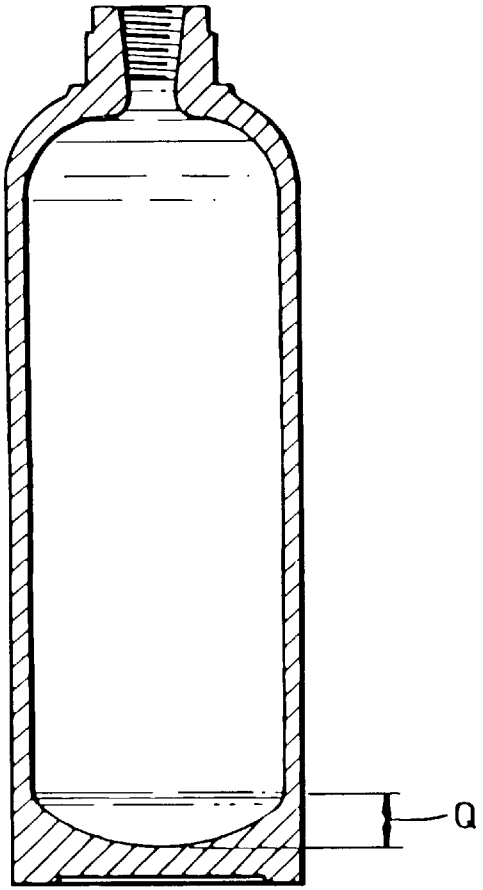

The introduction of compressive stresses into the base region of a cylinder by autofrettage are governed by the design of the cylinder base and particularly the knuckle region. This is illustrated by reference to three gas cylinders of different design, each 176 mm external diameter with an operating pressure of 20 MPa, a wall thickness of 8.9 mm and a minimum base thickness of 12.5 mm. The external surface of the base of each vessel was effectively flat. The internal shape of the base of each vesel was as follows:

a) This was an internal semi-ellipsoidal base design shown in FIG. 6. The internal surface of the base was concave with a depth (the dimension Q of 30.5 mm.

b) This was a torispherical base design with a base depth of 36.85 mm.

c) This was another torispherical design with a base depth of 49.57 mm.

von Mises stress values in the knuckle regions of these gase cylinders have been calculated, and the results are set out in Table 8. Note that the autofrettage pressure used was 90% of the actual burst pressure.

The semi-ellipsoidal design a) introduces a peak stress at the internal surface of the knuckle region of 306 MPa when subjected to its service pressure of 20 MPa, and of 441 MPa when subjected to a test pressure of 30 MPa. However, after autofrettage at 90% of the actual burst pressure, the stresses are reduced to 214 MPa and 288 MPa respectively within the knuckle region and 151 MPa and 242 MPa respectively at the internal surface of the knuckle region.

Torispherical base designs generally exhibit lower stresses at operating pressures. Thus torispherical base design b) introduces a peak stress

TABLE 8 von MISES STRESS VALUES IN THE KNUCKLE REGION OF 176 mm DIAMETER GAS CYLINDERS

| | KNUCKLE | MAXIMUM von MISES STRESS (STRESS REDUCTION IN BRACKETS) | | | |
|---|---|---|---|---|---|
| BASE DESIGN | RADIUS STRESS LOCATION | @ 20 MPa No Autofrettage | @ 30 MPa No Autofrettage | @ 20 MPa After Autofrettage | @ 30 MPa After Autofrettage |
| SEMI-ELLIPSOIDAL | Region | 306.2 | 440.8 | 214.3 (91.9) | 287.8 (153) |
| | Surface | — | — | 151.2 (155.0) | 241.7 (199.1) |
| TORISPHERICAL 1 | Region | 226.9 | 340.8 | 179.6 (47.3) | 256.1 (84.2) |
| | Surface | — | — | 161.1 (65.8) | 249.5 (90.8) |
| TORISPHERICAL 2 | Region | 197 | — | 197 | |
| | Surface | — | — | 197 | |

at the internal surface of the knuckle region, of 227 MPa at service pressure, and of 341 at test pressure. However, autofrettage is still effective in reducing these stresses. After autofrettage at 90% of the actual burst pressure these stresses are 180 MPa and 256 MPa respectively within the knuckle region and 161 MPa and 250 MPa respectively at the surface of the knuckle region.

In both these cases a) and b) the stress levels at or adjacent the external surface at the centre of the base are reduced similarly, i.e. autofrettage introduces compressive stresses in this area also.

In designs a) and b) the region of peak stress after autofrettage was located in the knuckle more than 0.5 mm from the internal surface of the vessel.

Internal torispherical base design c) is more effective in reducing stresses at operating pressure than both the previous designs discussed. Thus at service pressure the highest stress predicted with FE analysis was at the internal surface of the knuckle region and meansured 197 MPa. There was no reduction in this stress after autofrettage at 90% of the actual burst pressure. (A higher autofrettage pressure would have been effective to reduce the stress).

Although the torispherical base design c) does have advantages with respect to standard operating conditions over the other two examples, i.e. lower stress, there are also several disadvantages:

i) Stresses cannot be reduced by autofrettage.

ii) Maximum stress is at the internal surface of the knuckle region surface, i.e. it cannot be moved internally to within the cylinder wall.

iii) Surface stress levels at the knuckle region are lower after autofrettage for the ellipsoidal and torispherical designs a) and b).

iv) Without machining, the weight of a flat bottomed cylinder with a torispherical base design c) is greater than either of the two other designs a) and b).

What is claimed is:

1. A method of treating a pressure vessel comprised of one of aluminium and an Al alloy, having a cylindrical side wall and a closed end and a service pressure and having, when at said service pressure, at least one region of peak stress located at a surface, which method comprises the steps of subjecting the inside of the vessel to autofrettage by applying a pressure sufficient to plastically deform said peak stress surface, said plastic deformation being confined to less than 25% of the wall thickness, whereby the treated pressure vessel has the property that, when at said service pressure, each region of peak stress is located away from said peak stress surface at a distance less than 25% of the wall thickness at said surface.

2. A method as claimed in claim 1, wherein the aluminium is a 7000 or 6000 or 2000 Series alloy.

3. A method as claimed in claim 1, wherein prior to said subjecting step, said method includes the step of forming the pressure vessel by backward extrusion.

4. A method as claimed in claim 1, wherein plastic deformation of the metal takes place at an internal knuckle where the closed end joins the side wall and/or axially of the vessel at the outer surface of the closed end.

5. A method as claimed in claim 1, wherein said applied pressure is such as not significantly to plastically deform the side wall of the vessel.

6. A method according to claim 1 wherein the pressure applied to achieve autofrettage is such as to limit plastic deformation of a side wall including said peak stress surface to a thickness less than 10% of the side wall.

7. A method according to claim 1 wherein in the treated pressure vessel at elevated pressure said region of peak stress is remote from any internal or external surface by at least 0.5 mm.

8. A method according to claim 1 wherein in the treated pressure vessel at elevated pressure said region of peak stress is remote from any internal or external surface by a distance greater than a typical depth of surface flaws thereon.

9. A pressure vessel of aluminium or an aluminium alloy having an axis, a cylindrical side wall and a closed end joined to the side wall at a knuckle, and having the property that, when at elevated pressure, a region of peak stress is located, within the material of the vessel away from any internal or external surface at a distanceless than 25% of the wall thickness from said internal or external surface, in the knuckle and/or axially of the vessel in the closed end.

10. A pressure vessel as claimed in claim 9, wherein the aluminium is a 6000 or 7000 series alloy.

11. A pressure vessel as claimed in claim 9, having the property that, when at elevated pressure, the local stress in the cylindrical side walls decreases from the inner surface to the outer surface thereof.

12. A pressure vessel according to claim 9 wherein at elevated pressure said region of peak stress is remote from any internal or external surface by at last 0.5 mm.

13. A pressure vessel according to claim 9 wherein at elevated pressure said region of peak stress is remote from any internal or external surface by a distance greater than a typical depth of surface flaws thereon.

* * * * *